US008607937B2

(12) United States Patent
Gilli

(10) Patent No.: US 8,607,937 B2
(45) Date of Patent: Dec. 17, 2013

(54) ELEVATOR DOOR SYSTEM COMPRISING A CAR DOOR LOCKING MECHANISM

(75) Inventor: Rudolf Gilli, Dierikon (CH)

(73) Assignee: Inventio AG, Hergiswil (CH)

( * ) Notice: Subject to any disclaimer, the term of this patent is extended or adjusted under 35 U.S.C. 154(b) by 248 days.

(21) Appl. No.: 13/001,190

(22) PCT Filed: Jun. 4, 2009

(86) PCT No.: PCT/EP2009/056896

§ 371 (c)(1),
(2), (4) Date: Apr. 25, 2011

(87) PCT Pub. No.: WO2009/156256

PCT Pub. Date: Dec. 30, 2009

(65) Prior Publication Data

US 2011/0186386 A1 Aug. 4, 2011

(30) Foreign Application Priority Data

Jun. 25, 2008 (EP) ..... 08159042

(51) Int. Cl.
*B66B 13/12* (2006.01)

(52) U.S. Cl.
USPC ..... 187/319

(58) Field of Classification Search
CPC ..... B66B 13/12
USPC ..... 187/139, 330, 331, 335
See application file for complete search history.

(56) References Cited

U.S. PATENT DOCUMENTS

| | | | | |
|---|---|---|---|---|
| 3,783,977 | A | 1/1974 | Voser | |
| 5,732,796 | A * | 3/1998 | Ahigian et al. | 187/314 |
| 7,681,695 | B2 * | 3/2010 | Christen | 187/319 |
| 7,775,326 | B2 * | 8/2010 | Yumura et al. | 187/256 |
| 2006/0107785 | A1 * | 5/2006 | Zappa | 74/612 |
| 2007/0295564 | A1 * | 12/2007 | Someya | 187/319 |

FOREIGN PATENT DOCUMENTS

| | | | | |
|---|---|---|---|---|
| EP | 0332841 | B1 | 4/1992 | |
| EP | 1541517 | A1 | 6/2005 | |
| EP | 1914189 | A1 * | 4/2008 | B66B 13/12 |
| WO | WO 2006093020 | A1 * | 9/2006 | B66B 5/16 |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator includes an elevator car that has a horizontally movable car door leaf, a horizontally movable shaft door leaf, a car door locking mechanism encompassing a car door bolt and a bolt stop, and a coupling device that is connected to the car door leaf in order to transmit an opening movement or a closing movement from the car door leaf to the shaft door leaf. The coupling device has at least one movable entraining element which is brought in contact with an opposite element located on the shaft door leaf. A locking action of the car door locking mechanism depends on the cooperation of the coupling device with the opposite element. In each situation, the position of the car door bolt relative to the bolt stop exclusively depends on the position of the entraining element.

8 Claims, 5 Drawing Sheets

Fig. 3
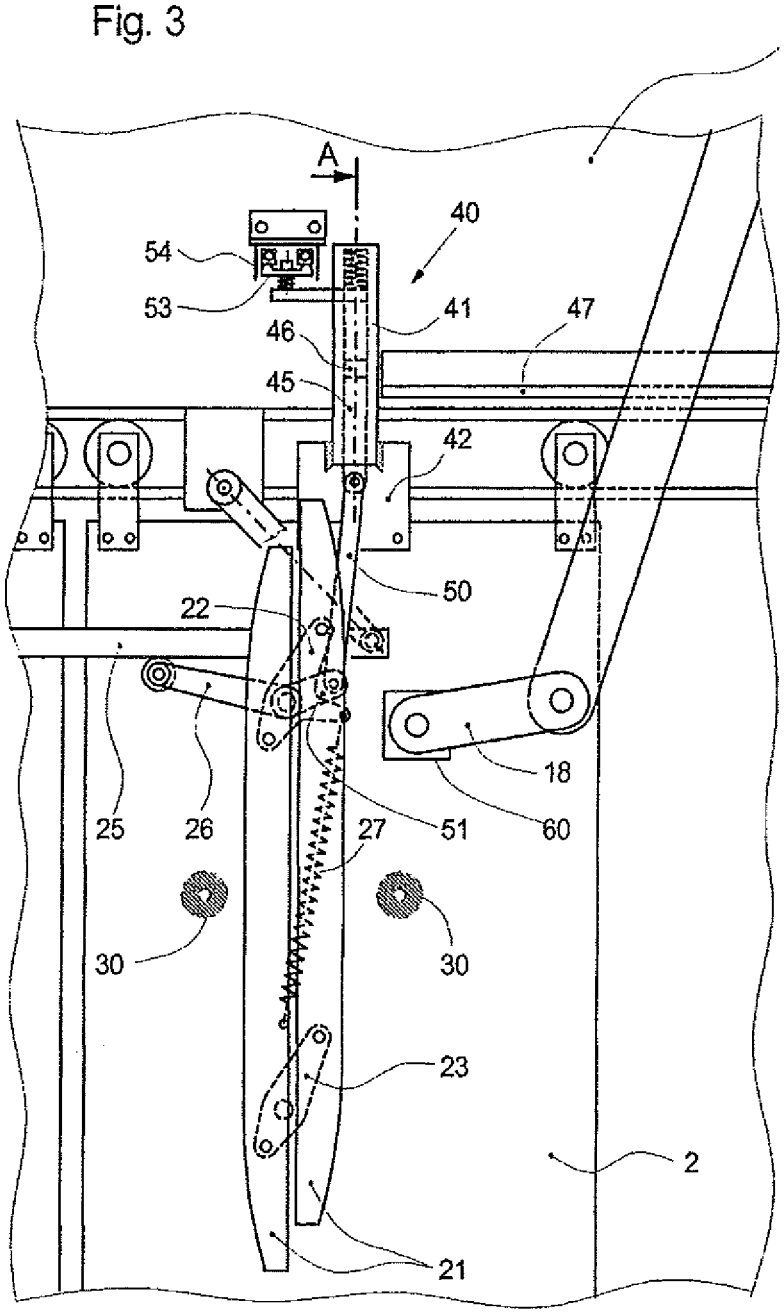
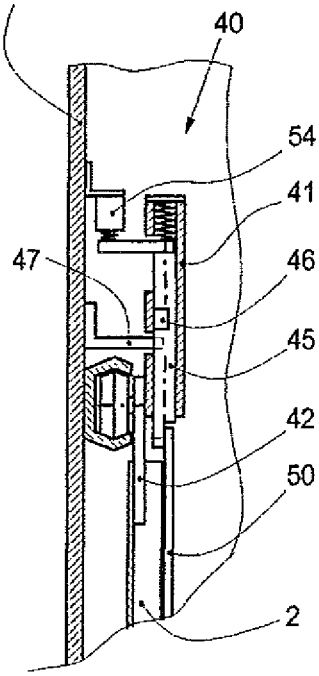
Fig. 3A
(Section A)

(Section A)

Fig. 5
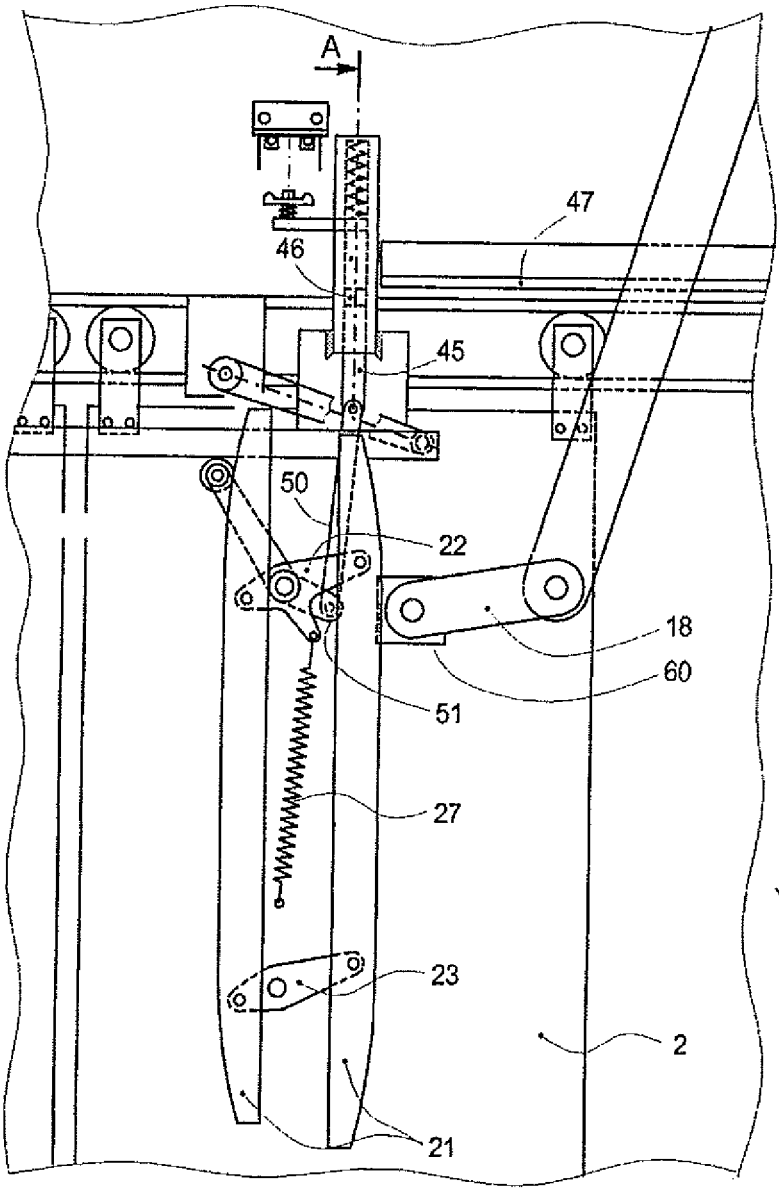
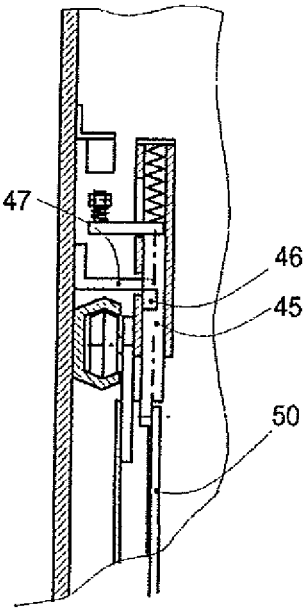
Fig. 5A
(Section A)

ELEVATOR DOOR SYSTEM COMPRISING A CAR DOOR LOCKING MECHANISM

FIELD OF THE INVENTION

The subject matter of the invention is an elevator having an elevator car, a horizontally moveable car door leaf, a horizontally moveable shaft door leaf, and a coupling device for transmitting an opening movement or a closing movement from the car door leaf to the shaft door leaf, wherein the coupling device comprises a moveable entraining element which, in order to couple the car door leaf to the shaft door leaf, can be brought into contact with an opposite element present on the shaft door leaf, wherein the interaction of the coupling device with the opposite element brings about unlocking of a car door bolt. Furthermore, a method for activating a car door bolt is a subject matter of the invention.

The invention relates to the problem of preferably permitting an opening movement of an elevator car door leaf when the elevator car is located at the level of a floor within permissible misalignments.

BACKGROUND OF THE INVENTION

U.S. Pat. No. 3,783,977 discloses a door drive device for opening and closing car door leaves of an elevator car door, wherein the door drive device comprises a car door locking mechanism. The door drive device is activated by means of a crank drive and comprises two coupling devices for transmitting the opening and closing movement from the car door leaves to corresponding shaft door leaves. The coupling devices each comprise two entraining rails which are guided on the car door leaf on pivotable connector levers and which can interact with, in each case, two opposite elements on the corresponding shaft door leaves when the elevator car is located at the level of a floor. The horizontal distance between two associated entraining rails can be changed by pivoting the connector levers, wherein the pivoting movements of the connector levers are generated by the crank drive in such a way that, when doors are closed, a minimum horizontal distance is present and therefore no interaction takes place between the entraining rails of the car door leaves and the opposite elements of the shaft door leaves, and therefore an increased horizontal distance is produced between the entraining rails when the doors are not closed. When the elevator car is located at the level of a floor, the increased horizontal distance between the entraining rails brings about a play-free coupling between the entraining rails and the opposite elements of corresponding car door leaves or shaft door leaves, wherein the horizontal distance between the entraining rails, and therefore the pivoting position of the connector levers, is limited by the opposite elements. If no such limitation takes place because the elevator car is not located at the level of a floor, there is a resulting increase in the specified horizontal distance and therefore in the pivoting travel of the connector levers. One of the pivoting levers has an extension which interacts with a stop (secured to the door frame) in such a way that the opening of the assigned car door leaf is blocked, when the specified horizontal distance between the entraining rails and therefore the pivoting position of the connector levers is not limited by the opposite elements on the corresponding shaft door leaf.

The door drive device which is known from U.S. Pat. No. 3,783,977, and which has a simple and cost-effective car door locking mechanism, has the disadvantage that the car door locking mechanism acts only when a triggered coupling process has not brought about coupling between the entraining rails and the opposite elements, because the elevator car is located above or below the level of a floor. The regulation which is contained in elevator standards, and which requires a car door locking mechanism to prevent any opening process outside the level of a floor in certain embodiments of the elevator system, is not satisfied by this car door locking mechanism.

Patent EP 0 332 841 B1 discloses a door drive device with a coupling mechanism for coupling a car door leaf to an assigned shaft door leaf. The coupling mechanism comprises two entraining runners which are oriented parallel to the direction of travel of the elevator car, and the distance between which can be adjusted by means of a parallelogram guide with two adjustment elements which can each pivot about a pivoting axis. When the elevator car is located at the level of a floor within permissible misalignments, the two entraining runners are located between two opposite elements arranged one next to the other on the shaft door leaf, and said entraining runners can be made to approach the latter laterally (can be spread) in order, on the one hand, to unlock the shaft door leaf and, on the other hand, to transmit the opening movement and closing movement of the car door without play and synchronously to the shaft door leaf. The distance adjustment between the two entraining runners is carried out here by means of a door drive unit which is attached to the car door frame, via a linearly acting drive means (for example by means of a belt drive) which also brings about the closing movements and opening movements of the car door leaf. In the process, the drive means engages, via a pivoting lever connected to the adjustment elements of the parallelogram guide, on the car door leaf in such a way that, before the start of a door leaf opening movement, the adjustment elements are pivoted, by the opening movement of the linearly acting drive means, into a position in which the entraining runners are made to approach the opposite elements, and as a result unlock the shaft door leaf and form the specified coupling between the car door leaf and the corresponding shaft door leaf.

At the end of a door leaf closing movement, the adjustment elements are pivoted, by the closing movement of the linearly acting drive means, back into a position in which the entraining runners are spaced apart from the opposite elements, so that the locking mechanism of the shaft door leaf returns to its locking position.

EP 0 332 841 B1 also discloses a device for unlocking the bolt of a car door locking mechanism which is intended to ensure that the car door is unlocked automatically only if the car door is located opposite a shaft door of the elevator.

For this purpose, one of the entraining runners has a sensing runner in the region of its outer runner face, i.e. the runner face which interacts with the corresponding opposite element on the shaft door leaf (coupling roller). Said sensing runner extends parallel to the entraining runner, and is connected thereto by means of connector springs in such a way that in the unloaded state said sensing runner is spaced apart from the entraining runner by several millimeters. The contact force which is applied to the sensing runner during a coupling process (entraining spreading) by the opposite element causes said sensing runner to move counter to the spring force of the connector springs in the direction of the entraining runner. The sensing runner has a cam which transmits its movement, brought about by the opposite element, with respect to the entraining runner and therefore with respect to the car door leaf to a car door bolt which is mounted on this car door leaf, and said cam unlocks the car door leaf. If a door opening command is issued and resulting spreading of the entraining runners of the coupling mechanism occurs when the door of the elevator car is not located opposite a shaft door, the entraining runners, like the sensing runner, do not enter into contact with one of the opposite elements on the shaft door leaves. The sensing runner is therefore not moved against the entraining runner, and the car door bolt remains in its locking position. A sensor which monitors the position of the car door bolt additionally prevents the door drive motor from switching on.

The illustrated coupling mechanism with a car door unlocking mechanism requires on one of the entraining runners a sensing runner which can move relative to the latter and is guided in parallel, which is associated with a high degree of expenditure in terms of material and fabrication. The relatively small sensing travel of the sensing runner requires a lever system with a large transmission ratio, in order to generate sufficient unlocking travel at the car door bolt. This requires the coupling device and the car door unlocking device to be fabricated with high precision. Furthermore, jolt-like accelerations of the car door bolt result from the large transmission ratio when the sensing runner strikes against the opposite element, and this can result in undesired noises.

A further device for coupling a car door leaf of an elevator car to a corresponding shaft door leaf, which device interacts with a car door locking mechanism, is known from EP 1 541 517 A1. The method of functioning of said device corresponds largely to that of the device according to EP 0 332 841 B1 which is described above. In contrast to the device according to EP 0 332 841 B1, a sensing runner is not arranged on an entraining runner in the device according to EP 1 541 517 A1, but instead the function of the sensing runner is integrated into one of the entraining runners. This is implemented by virtue of the fact that this entraining runner is connected via joint elements to the pivotable adjustment elements, which through their pivoting movement change the distance between the entraining runners.

The device known from EP 1 541 517 A1 has essentially the same disadvantages as those mentioned above in conjunction with the device according to EP 1 541 517 A1.

SUMMARY OF THE INVENTION

The present invention is based in particular on the object of providing an elevator with a car door locking mechanism which is in accordance with the regulations, and which can be implemented easily and cost-effectively and requires a low degree of manufacturing and installation accuracy. Furthermore, such a car door locking mechanism is to operate with little noise.

A number of important aspects to the inventive solution can be seen in the fact that, in the elevator according to the invention, a coupling device provided on the car door leaf has at least one moveable entraining element which can be brought into contact, by means of a coupling movement, with an opposite element which is present on the shaft door leaf. A locking effect of the car door locking mechanism is dependent on the interaction of the coupling device with the opposite element, wherein each position of the entraining element is unambiguously assigned a corresponding position of the car door bolt. The terms "position of the entraining element" and "position of the car door bolt" are each to be understood here as meaning the relative position of the entraining element or of the car door bolt with respect to the car door leaf to which both the entraining element and the car door bolt are connected. In the closed position of the car door leaf, a defined position of the car door bolt relative to the car door leaf also corresponds to a defined position of the car door bolt relative to the bolt stop. In other words, the car door bolt is preferably coupled to the moveable entraining element of the coupling device in such a way that its position relative to the car door leaf and therefore also to the bolt stop is determined unambiguously by the position of the entraining element, that is to say is directly and exclusively dependent on the position of the entraining element. In particular, the position of the car door bolt relative to the car door leaf, and therefore also to the bolt stop, is not to be influenced by a further element. In particular, a rigid coupling between the car door bolt and the entraining element is provided. The term "rigid coupling" is to be understood here as meaning that an operative connection is present between two components, which connection has the effect that in every operating situation a movement of the one component brings about a movement of the second component. Such a rigid coupling or operative connection can be composed, for example, of a joint mechanism or of a Bowden cable.

The invention permits a simple and cost-effective car door locking mechanism to be implemented, by virtue of the fact that a car door bolt is connected directly to the entraining element by simple mechanical coupling which is not very demanding in terms of precision and generates little noise.

The car door locking mechanism is advantageously configured in such a way that the car door bolt assumes a position in which it blocks an opening movement of the car door leaf when the entraining element is located in a through-travel position at a distance from the opposite element, in which through-travel position the elevator car with the coupling device can move past the shaft door leaf.

When a door opening process starts, the entraining element advantageously carries out the coupling movement from a through-travel position at a distance from the opposite element, in the direction of the opposite element, wherein the car door bolt is positioned in such a way that an opening movement of the car door leaf is possible when the entraining element is stopped in a defined coupling position by the opposite element.

When a door opening process begins, the entraining element advantageously carries out the coupling movement from a through-travel position at a distance from the opposite element, in the direction of the opposite element, wherein the car door bolt is positioned in such a way that it blocks the opening movement of the car door leaf when the entraining element moves further than up to a defined coupling position during the coupling movement. This situation occurs, for example, when an excessively large vertical misalignment is present between the car door leaf and the shaft door leaf, meaning that during its coupling movement the entraining element does not engage with the opposite element.

The elevator is advantageously configured in such a way that at least the following method steps can be carried out:

movement of the car door bolt into a position in which it blocks an opening movement of the car door leaf when the entraining element of the coupling device is located in the through-travel position, movement of the car door bolt into a position in which it permits an opening movement of the car door leaf when the coupling movement of the entraining element is stopped in a defined coupling position by the opposite element, movement of the car door bolt into a position in which it blocks an opening movement of the car door leaf when the entraining element moves further than up to the defined coupling position during the coupling movement.

The movement of the car door bolt is advantageously rigidly coupled to the movement of the entraining element via a lever system. The term "rigidly coupled" is to be understood here as meaning that between two components there is a coupling which ensures that, in any possible situation, a movement of the one component in the coupling direction inevitably brings about a movement of the second component in the coupling direction.

The car door bolt is advantageously present in the form of a slide which can be moved in a bolt guide provided on the car door leaf, and said slide interacts with a bolt stop which is connected in a non-moveable fashion to the car door structure, wherein the car door bolt has a recess which permits the car door bolt and therefore the car door leaf to carry out an opening movement past the bolt stop when the coupling movement of the entraining element has been stopped by the opposite element in a coupling position which is provided.

The coupling device advantageously comprises two entraining elements which can be adjusted in terms of their distance from one another, and which interact with two opposite elements of a shaft door leaf in order to couple the car door leaf to the shaft door leaf and also to unlock a shaft door locking mechanism via at least one moveable opposite element.

The two entraining elements are advantageously arranged between two opposite elements of the shaft door leaf when the elevator car is located at the level of a floor, wherein the entraining elements are pressed against the opposite elements by a spring before the opening movement of the car door leaf begins.

In each case two opposite elements of the shaft door leaf are advantageously arranged between the two entraining elements when the elevator car is located at the level of a floor, wherein the entraining elements are pressed against the opposite elements by a spring before an opening movement of the car door leaf begins.

A closed position of the car door leaf and a locking position of the car door bolt are advantageously monitored by an elevator controller, wherein a switching element, which is coupled to the car door bolt, of an electrical switch spans the contacts thereof when the car door leaf is closed and at the same time the car door bolt is positioned in the correct locking position.

A car door drive advantageously acts on the car door leaf via an elastic coupling element, wherein the deformation, generated by the drive force, of the elastic coupling element is monitored by means of a detector in order to stop the car door drive or the door drive motor if, for example, the car door bolt blocks the car door leaf when the door opening movement begins.

DESCRIPTION OF THE DRAWINGS

An exemplary embodiment of the invention is explained below with reference to the appended drawings, in which:

FIG. 3 shows a view of a detail of a car door leaf with a coupling device and car door locking mechanism according to FIGS. 1 and 2, in the closed position which is locked when the vehicle is ready to travel;

FIG. 3A shows a section through the car door locking mechanism according to FIG. 3;

FIG. 5 shows a view of a detail of a car door leaf with a coupling device and car door locking mechanism according to FIGS. 1 and 2, in a closed position which is locked due to a lack of opposite elements; and FIG. 5A shows a section through the car door locking mechanism according to FIG. 5.

DESCRIPTION OF PREFERRED EMBODIMENTS

Figure 1:
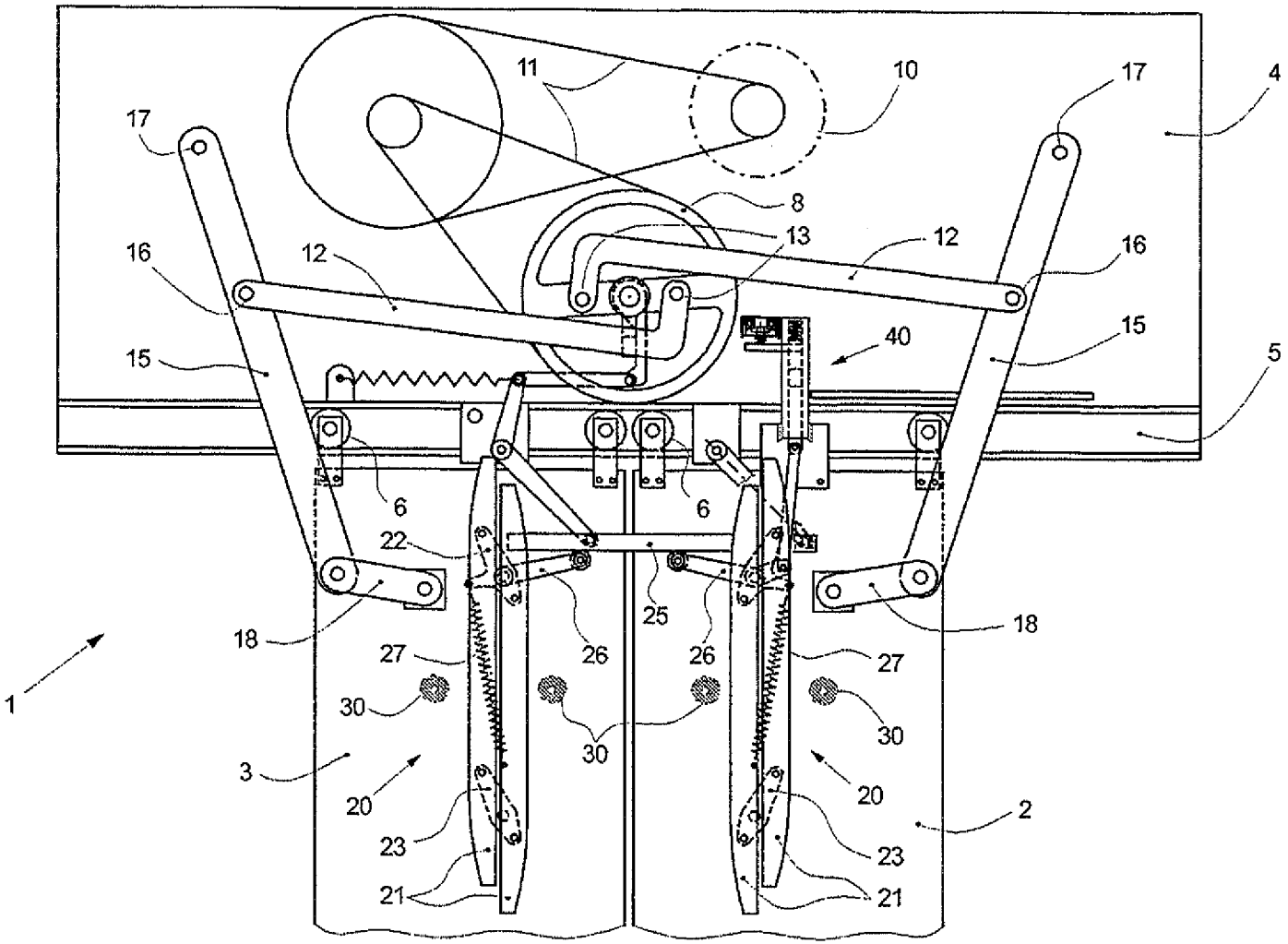
FIG. 1 shows the view of a car door of an elevator according to the invention having a door drive and two closed car door leaves having, in each case, a coupling device, wherein one of the car door leaves is equipped with a car door locking mechanism.

FIG. 1 shows a car door 1, comprising two car door leaves 2, 3, of an elevator car (not illustrated here) of an elevator according to the invention. The car door leaves 2, 3 are located in their closed position. A mounting plate 4 bears virtually all the components of the car door 1 and is connected to the elevator car. At its lower end, the mounting plate 4 has a guide profile 5 for guiding the supporting rollers 6 of the two car door leaves 2, 3. Mounted in the center of the mounting plate 4 is a crank wheel 8 which can be rotated through approximately half a revolution in respectively alternating directions via a belt reduction gear 11 by means of a door drive motor 10. Reference 12 denotes two crank rods which are each pivotably mounted by a respective first end on crank pins 13, lying diametrically opposite one another, of the crank wheel 8, and by respective second ends on coupling joints 16 of two drive levers 15. These drive levers 15 are pivotably mounted at their one end on rotational points 17 in the mounting plate 4 and at their other ends they are connected via intermediate levers 18 to, in each case, one of the two car door leaves 2, 3. In order to open or close the car door leaves 2, 3, the crank wheel 8 is respectively rotated by half a revolution in the clockwise direction or counterclockwise direction, wherein the resulting horizontal movement of the crank pins 13 is transmitted by means of the crank rods 12 to the coupling joint 16 of the drive levers 15. As a result, these drive levers are pivoted through a defined angle, wherein they move, i.e. open or close, the car door leaves 2, 3 over a defined distance via the intermediate levers 18.

Mounted on each of the car door leaves 2, 3 is a coupling device 20 which serves to transmit the movements of the car door leaves synchronously to a respectively corresponding shaft door leaves (not illustrated). For this purpose, each shaft door leaf is equipped with two opposite elements 30 in the form of what are referred to as coupling rollers with which the assigned coupling devices 20 interact in order to couple the car door leaves to the corresponding shaft door leaves in the horizontal direction, provided that the elevator car is positioned at the level of a floor opposite a shaft door within permissible vertical misalignments. The opposite elements 30 which are assigned to the shaft door leaves (not illustrated in FIG. 1) are indicated in FIG. 1 by means of dot-dash lines and are marked by dark coloring.

Each of the coupling devices 20 provided on one of the shaft door leaves comprises two entraining elements 21 in the form of parallel entraining runners, which are connected to the assigned car door leaf 2, 3 so as to be pivotable by means of, in each case, one upper pivoting lever 22 and one lower pivoting lever 23, wherein the two pivoting levers 22, 23 form a parallelogram guide for the two entraining elements 21. The entraining elements which are each assigned to a car door leaf can be adjusted in terms of their distance from one another by pivoting the two pivoting levers 22, 23. The crank wheel 8 described above determines, via an illustrated lever system, the vertical position of a pressure bar 25 which is pivotably mounted on the mounting plate 4. This pressure bar 25 interacts with two sensing levers 26, one of which is rigidly connected in each case to one of the pivoting levers 22 and can pivot about the axis thereof. Just before the crank wheel 8 respectively reaches its end position (after half a revolution in the counterclockwise direction) which determines the closed position of the car door leaves, said crank wheel 8 causes, via the lever system, the pressure bar 25 to be lowered into its lower end position. In the process, the pressure bar 25 presses on the two sensing levers 26 in such a way that said pivoting levers 22, 23 which guide the entraining elements 21 pivot counter to the effect of a spreading spring 27 into a position in which the respectively assigned entraining elements 21 are at a minimum distance from one another. In this position, the entraining elements are spaced apart sufficiently in the horizontal direction from the two opposite elements 30 which are connected to the shaft door leaves, so that the elevator car with the coupling devices 20 can move past the opposite elements and therefore the shaft door leaves or the shaft doors in a contact-free fashion.

Figure 2:
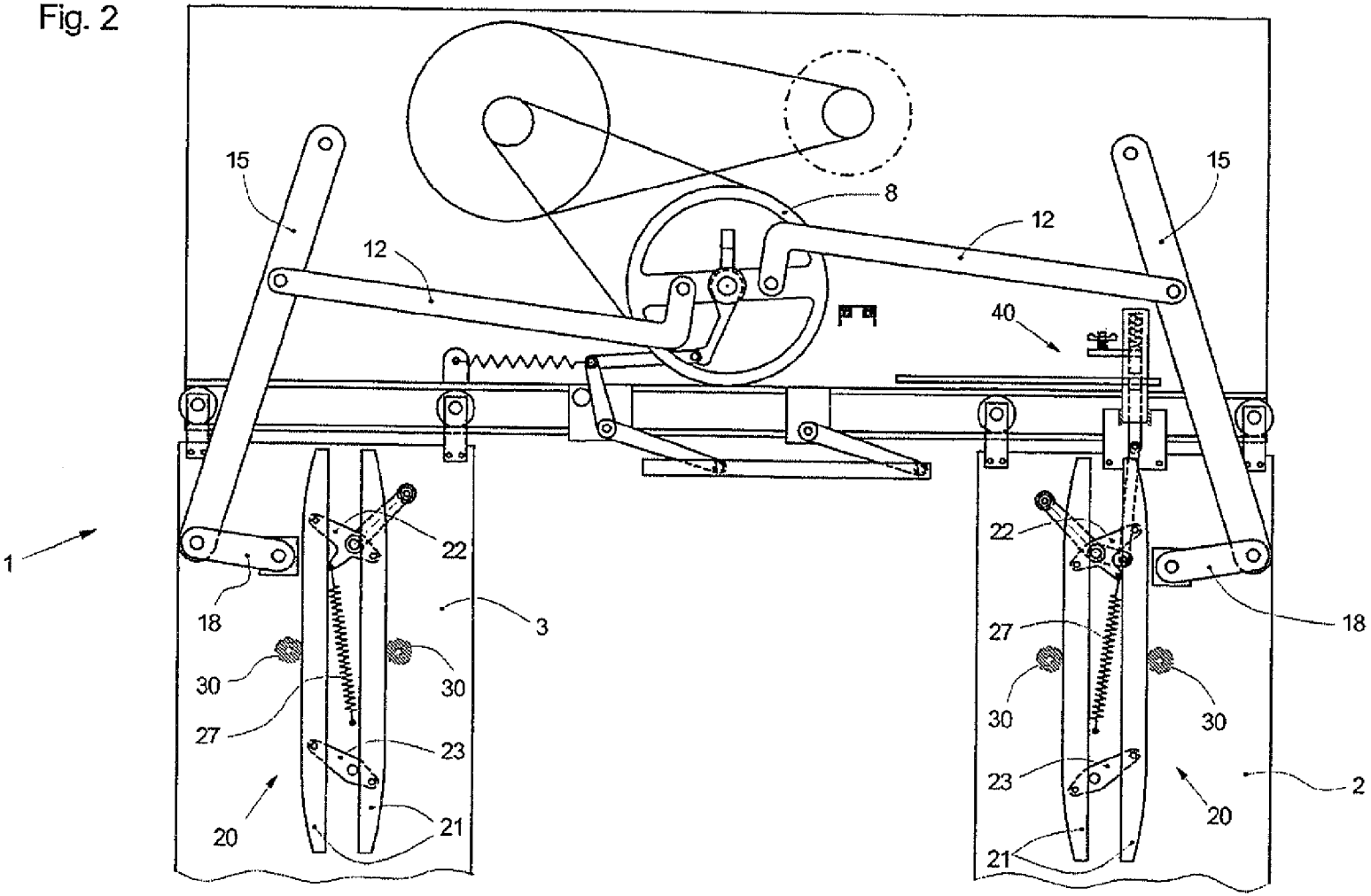
FIG. 2 shows the view of the car door according to FIG. 1 but with opened car door leaves.

FIG. 2 shows the car door 1 described above with the car door leaves 2, 3 in the open position. This open position usually occurs temporarily when the elevator car stops at a correct level of a stopping position at a floor. The entraining elements 21 of the coupling devices 20 are pressed, as a result of the force of the spreading spring 27, against the opposite elements 30 which are present on the shaft door leaves, and are spaced apart from one another as far as is permitted by the distances present between the opposite elements 30. In order to open the car door leaves 2, 3, the crank wheel 8 has rotated through approximately half a revolution in the clockwise direction and in the process has opened the car door leaves via the crank rods 12, the drive levers 15 and the intermediate levers 18. When the opening rotational movement of the crank wheel 8 began, said crank wheel 8 released the pressure bar 25 which was previously forced into its lowered position, and a tension spring raised the pressure bar via the illustrated lever system. As a result, due to the effect of the spreading spring 27, the sensing levers 26 which interact with the pressure bar, and with these the pivoting levers 22, 23 of the coupling devices 20, carried out a pivoting movement by which the entraining elements 21 of the coupling devices 20 were spread apart from one another until the spreading movement was stopped by the contact between the entraining elements and the respectively assigned opposite elements 30.

This process brought about the coupling between the car door leaves 2, 3 and the corresponding shaft door leaves (not illustrated).

A car door locking mechanism 40 is illustrated in FIGS. 1 and 2 at the upper edge of the car door leaf 2. Said car door locking mechanism 40 has the function of blocking the car door leaf 2 in its closed position when, for example, the entraining elements are located in their position with a minimum distance from one another, i.e. when the crank wheel and the car door leaves are located in a position in which travel of the elevator car is permitted. Blocking is also to take place when, at the start of an intended door opening process, the entraining elements 21 do not abut against opposite elements 30 of a shaft door because the elevator car is not located in the region of a stopping point at a floor.

The details of this car door locking mechanism 40 are illustrated in enlarged form in FIGS. 3, 3A, 4 and 4A, and the method of operation of the car door locking mechanism is described in more detail in the text which follows.

FIGS. 3 and 3A show the car door 1 in its closed position. By means of the abovementioned lever system, the pressure bar 25 which has been lowered by the latter, the sensing lever 26 and the pivoting levers 22, 23, the crank wheel (not visible here) has brought the entraining elements 21 into their passage position in which they are at a minimum distance from one another. The car door locking mechanism 40 comprises a bolt guide 41 which is secured to the upper edge of the car door leaf 2 by means of a connecting plate 42, a rod-shaped car door bolt 45 which can be moved vertically in the bolt guide 41 and has a passage groove 46, as well as a bolt stop 47 which is connected in a non-moveable fashion to the mounting plate 4. The bolt guide 41, with the car door bolt 45 guided therein, and the bolt stop 47 are arranged with respect to one another in such a way that the car door bolt 45 collides with the bolt stop 47 and therefore prevents an opening movement of the car door leaf 2 when the car door bolt 45 is not positioned in the bolt guide 41 in such a way that its passage groove 46 is aligned with the bolt stop 47 in the opening direction. The vertical position of the car door bolt 45 is determined by the pivoting position of the pivoting levers 22, 23 which guide the entraining elements 21 of the coupling devices, and therefore by the position of these entraining elements 21. Specifically, the position of the car door bolt 45 is determined by virtue of the fact that the car door bolt is coupled by means of a push rod 50 to a locking lever 51 which is secured on the pivoting axis of the pivoting lever 22, and which is rotated in each case through the same pivoting angle as the pivoting lever which determines the position of the entraining elements.

FIGS. 3 and 3A show the car door 1 in the situation which is a precondition for the operational capability of the elevator car. The illustrated car door leaf 2 is located in its closed position. In this situation, the crank wheel 8 (not illustrated here) is in its end position which it has reached after half a revolution in the counterclockwise direction, and in which, as described above, the entraining elements 21 are positioned via a lever system in a position in which they are at a minimum distance from one another. In the process, the pivoting levers 22, 23 assume their position in which they are pivoted to a maximum extent in the counterclockwise direction and the locking lever 51, which pivots synchronously with the pivoting lever about the same pivoting axis, is directed to the right in the upward direction here. In this position, the locking lever 51 positions, via the push rod 50, the car door bolt 45 in its uppermost position in which the passage groove 46 of the car door bolt is not aligned with the bolt stop 47, so that an opening movement of the car door leaf 2 is prevented. A contact element 53 is connected to the car door bolt 45, which contact element 53 interacts with the contacts of a safety switch 54, which is secured to the mounting plate, in order to signal to the elevator controller when the car door leaf 2 is closed and locked.

As already described, when a door opening process begins the crank wheel causes, via the aforementioned lever system, the pressure bar 25 to be raised into its upper position. This takes place when a rotational movement of the crank wheel begins in the clockwise direction, and preferably before the car door leaves 2, 3 carry out an appreciable movement. As a result of the effect of the spreading spring 27, a rotational movement of the sensing lever 26, of the pivoting levers 22, 23 and of the locking lever 51 occurs here, and this is connected to an increase in the distance—i.e. with a spreading movement—between the two entraining elements 21. This spreading movement, which is also referred to as a coupling movement, is limited by the fact that the entraining elements 21 come to a stop against the opposite elements 30 of the shaft door leaves, provided that the opposite elements 30 of a shaft door leaf are located in the region of the vertical extent of the entraining elements 21 of the car door leaf 2. This is always the case when the elevator car is located at the level of a floor within permissible tolerances. In this situation, the car door bolt 45 is positioned, via the push rod 50 and by the locking lever 51 which pivots synchronously with the pivoting levers, at a height at which the passage groove 46 which is present in the car door bolt is aligned with the bolt stop 47 in the opening direction of the car door leaf, and the opening movement of the car door leaf 2, which is brought about by the continued rotation of the crank wheel, is made possible. This position of the coupling device 20 and of the car door locking mechanism 40 is illustrated in FIGS. 4 and 4A.

Figures 4, 4A:
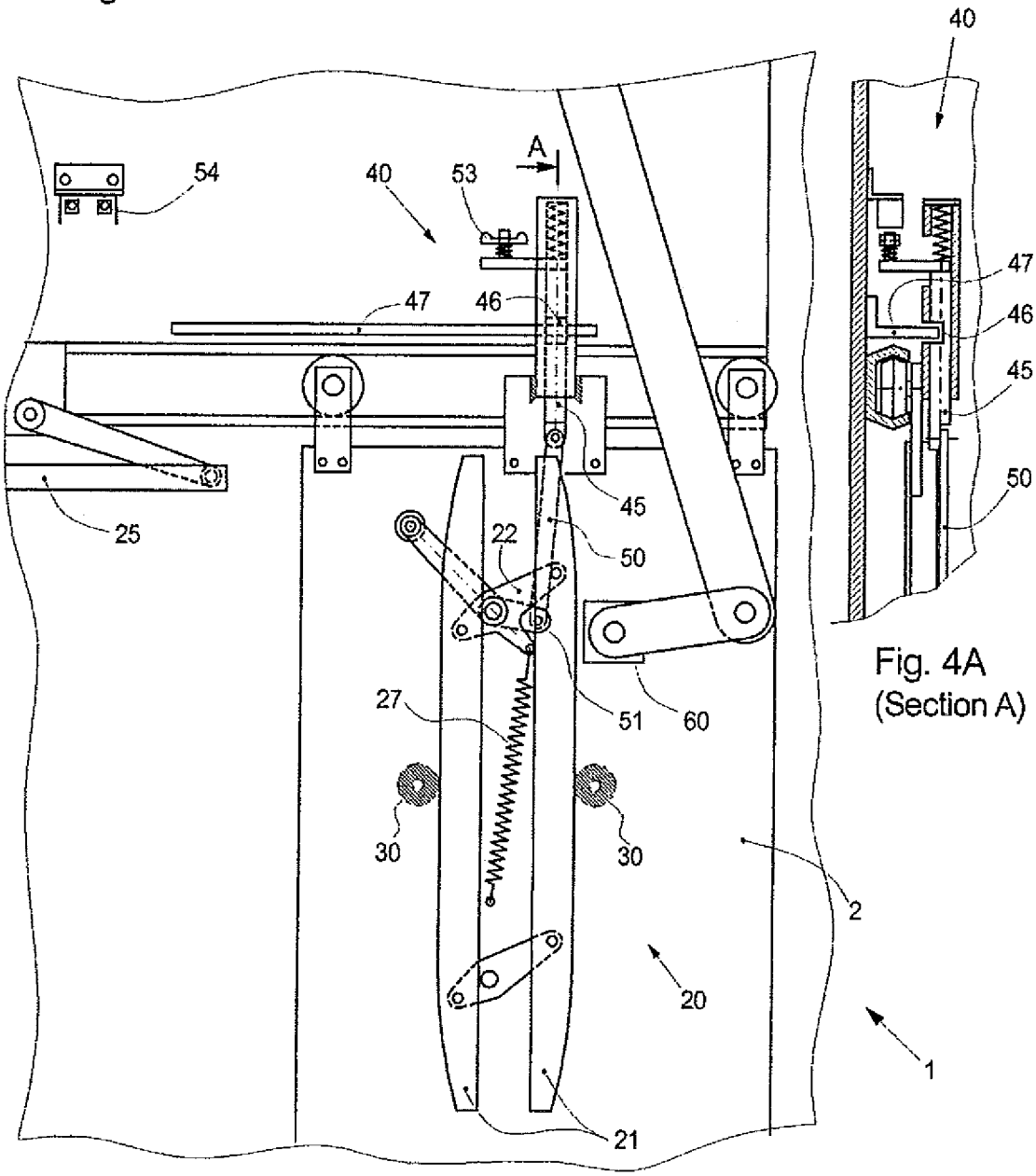
FIG. 4 shows a view of a detail of a car door leaf with a coupling device and a car door locking mechanism according to FIGS. 1 and 2, in an open position.
FIG. 4A shows a section through the car door locking mechanism according to FIG. 4.

FIGS. 4 and 4A show the car door 1 in its open position which it has reached after a door opening process. The positions of the coupling device 20, of the car door locking mechanism 40 and also of the contact element 53 of the safety switch 54, which positions are assigned to this state, are illustrated.

The bolt stop 47 is extended in length in accordance with the entire opening movement of the door leaf 2, so that the car door bolt 45 cannot drop and can collide with the rear side of the bolt stop when the car door leaf closes. This measure ensures that the door leaf can be closed even if, for example in the event of a power failure, the car door bolt drops out of its non-locking position when the car door leaf is open.

However, if at the beginning of a door opening process the elevator car is not located in the provided region of the level of a floor, so that no opposite elements 30 of a shaft door leaf lie in the region of the vertical extent of the entraining elements 21 of the car door leaf, when the door opening process begins, the coupling movement, driven by the spreading spring 27, of the two entraining elements 21 is not limited by opposite elements 30. This results in the pivoting levers 22, 23 and therefore also the locking lever 51 which pivots synchronously with the latter being pivoted by the effect of the spreading spring 27 in the clockwise direction to such an extent that the car door bolt 45 is lowered, by the locking lever via the push rod 50, below its position in which the passage groove 46, present in the car door bolt, is aligned with the bolt stop 47 in the opening direction of the car door leaf. In this situation also, the opening movement of the car door leaf 2, driven by the crank wheel, is blocked by virtue of the fact that the car door bolt 45, which is connected to the car door leaf 2, runs up against the bolt stop. This situation is illustrated by FIGS. 5 and 5A.

If an attempted opening movement of the car door leaf 2 is blocked by the car door locking mechanism, this results in an increase in force in the drive train of the door drive. This increase in force is advantageously detected and a corresponding signal is used to switch off or reverse the door drive motor 10. In the present exemplary embodiment, the drive force is transmitted to the car door leaves 2, 3 via the intermediate levers 18 (FIG. 3, 5) and an elastic coupling element 60 (FIGS. 3, 5) which contains, for example, an elastomeric intermediate layer. In this context, a detector (not illustrated) senses the deformation of the elastomeric intermediate layer and generates the specified signal if a threshold value which has been set for the deformation is detected. This device is advantageously also used as what is referred to as a closing force monitoring means, with which an unacceptably strong force effect on passengers is prevented. Alternatively or additionally, the described function can be brought about through suitable monitoring of the motor current.

Of course, such a coupling device with a car door locking mechanism can also be implemented with a configuration in which the opposite elements of the shaft door leaves are arranged between the entraining elements of the coupling device.

The device according to the invention can also be implemented with a door drive which is not based on the principle of a crank drive. Basically, it is possible to use any door drive in which a coupling movement of an entraining element is carried out before an essential opening movement of the door leaf takes place. For example, the door drive which is described in EP 0 332 841 B1 can also be used. In this door drive, a car door leaf is driven by mean of a linearly acting drive means in the form of a circulating belt drive.

Of course, instead of the linearly moveable car door bolt it is also possible to use a car door bolt which can be pivoted about an axis, and the opening of the car door leaf is permitted only in a central pivoting position of said car door bolt.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator with an elevator car having car door with a horizontally moveable car door leaf, a horizontally moveable shaft door leaf, a car door locking mechanism having a car door bolt and a bolt stop as well as a coupling device which is connected to the car door leaf for transmitting an opening movement or a closing movement from the car door leaf to the shaft door leaf, comprising:

the coupling device including a moveable entraining element which is brought into contact, by a coupling movement, with an opposite element arranged on the shaft door leaf, and a locking effect of the car door locking mechanism is dependent on an interaction of the coupling device with the opposite element; and the car door bolt being formed as a slide which is slidably movable in a bolt guide provided on the car door leaf, a movement of the car door bolt being rigidly coupled to the movement of the entraining element, and the car door bolt interacting with the bolt stop which is fixed to the car door, wherein the car door bolt blocks an opening movement of the car door leaf by contact with the bolt stop when the entraining element is located in a through-travel position at a distance from the opposite element, the car door bolt permits the opening movement of the car door leaf when the entraining element is stopped in a defined coupling position by the opposite element, the car door bolt blocks the opening movement of the car door leaf by contact with the bolt stop when the entraining element moves further than up to the defined coupling position during the coupling movement, and wherein the car door bolt has a recess which permits the car door bolt and the car door leaf to carry out the opening movement past the bolt stop when the coupling movement of the entraining element has been stopped by the opposite element in the defined coupling position.

2. The elevator according to claim 1 wherein movement of the car door bolt is rigidly coupled to movement of the entraining element by a lever system.

3. The elevator according to claim 1 wherein the coupling device includes another moveable entraining element wherein the two entraining elements are adjustable in distance from one another and each of the entraining elements interacts with an associated one of two of the opposite elements of the shaft door leaf to couple the car door leaf to the shaft door leaf.

4. The elevator according to claim 3 wherein the two entraining elements are arranged between the two opposite elements of the shaft door leaf when the elevator car is located at a floor of the shaft door, wherein the entraining elements are pressed against the opposite elements by a spring before the opening movement of the car door leaf begins.

5. The elevator according to claim 3 wherein the two entraining elements are pressed against the opposite elements by a spring before the opening movement of the car door leaf begins.

6. The elevator according to claim 1 including an electrical safety switch for monitoring a closed position of the car door leaf and a locking position of the car door bolt, wherein a contact element, which is coupled to the car door bolt, spans contacts of the electrical safety switch when the car door leaf is closed and at the same time the car door bolt assumes the locking position.

7. The elevator according to claim 1 including a car door drive acting on the car door leaf through an elastic coupling element, wherein a deformation, generated by a drive force, of the elastic coupling element is monitored to stop a door drive motor if the car door bolt blocks the car door leaf when the car door leaf opening movement begins.

8. A method for activating a car door bolt of a car door locking mechanism of an elevator, in which a horizontally moveable car door leaf is coupled to a horizontally moveable shaft door leaf in order to transmit an opening movement or a closing movement, comprising the steps of:

moving in a coupling movement a moveable entraining element of a coupling device on the car door leaf into contact with an opposite element arranged on the shaft door leaf, wherein a locking effect of the car door locking mechanism is dependent on an interaction of the coupling device with the opposite element, and wherein movement of the car door bolt is rigidly coupled to the movement of the entraining element;

blocking an opening movement of the car door leaf by contact of the car door bolt with a bolt stop when the entraining element is located in a through-travel position at a distance from the opposite element;

permitting the opening movement of the car door leaf by the car door bolt when the entraining element is stopped in a defined coupling position by the opposite element;

blocking the opening movement of the car door leaf by contact of the car door bolt with the bolt stop when the entraining element moves further than up to the defined coupling position during the coupling movement;

wherein the car door bolt is a slide slidably moveable in a bolt guide on the car door leaf and the slide interacts with the bolt stop which is fixed to the car door; and wherein the car door bolt has a recess which permits the car door leaf to carry out the opening movement past the bolt stop when the coupling movement of the entraining element is stopped by the opposite element in the defined coupling position.

* * * * *